US005607162A

United States Patent [19]

Boylan et al.

[11] Patent Number: 5,607,162

[45] Date of Patent: Mar. 4, 1997

[54] METHOD OF PLAYING A MATCHING CARD GAME

[75] Inventors: Eugene B. Boylan, Minden; Robert F. Koerner, Gardnerville; Russell R. Hebert, Carson City, all of Nev.; Robert Megli, South Lake Tahoe, Calif.

[73] Assignee: Bet Technology, Inc., Carson City, Nev.

[21] Appl. No.: 618,557

[22] Filed: Mar. 20, 1996

[51] Int. Cl.[6] ..... A63F 1/00

[52] U.S. Cl. ..... 273/292; 273/274

[58] Field of Search ..... 273/292, 274, 273/303, 306, 293

[56] References Cited

U.S. PATENT DOCUMENTS

| | | | |
|---|---|---|---|
| 4,651,997 | 3/1987 | Wood | 273/274 |
| 5,324,041 | 6/1994 | Boylan et al. | 273/292 |

OTHER PUBLICATIONS

"Monte", Eights, Mau–Mau, Scarne's Encyclopedia of Games by John Scarne, pp. 310–311, 331, 332, 334, 335, Harper & Row Publishers, 1973.,

*Primary Examiner*—Benjamin H. Layno
*Attorney, Agent, or Firm*—Larson and Taylor

[57] ABSTRACT

A method of playing a matching wagering game is provided between players and a dealer whose outcome is determined by randomly generated playing cards. After an ante bet is wagered, the dealer deals five cards to each player and deals seven cards to himself. A round of play is then commenced where the dealer plays a card from his hand to present the rank and suit thereof. Next, each player plays a "matching" card from his respective hand which is either the same suit or the same rank. In this manner, each player reduces the number of cards in his hand where a matching card is played during the round. The conducting of a round step is then repeated until each card in the hand of the dealer has been played. Seven rounds are thus played each game, so that ultimately there are no cards left in the hand of the dealer. The ante bet of each respective player is consequently paid off (a) to each player if each player has no card remaining, or (b) to the dealer if each player has one or more cards remaining. Preferably, prior to the conducting step, each player determines whether his respective hand has a hand rank in poker exceeding three of a kind. If the player does have such a highly ranked hand, the dealer pays off an amount to that player which is a multiple of the ante bet.

13 Claims, 1 Drawing Sheet

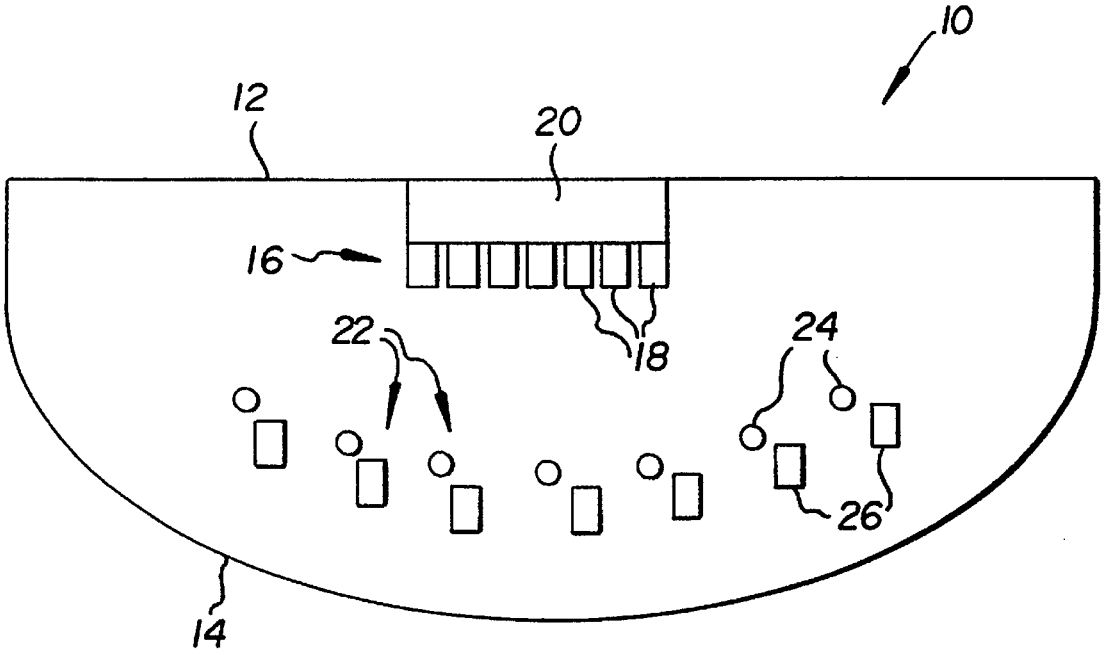
10
12
20
16
18
22
24
26
14

METHOD OF PLAYING A MATCHING CARD GAME

FIELD OF THE INVENTION

The present invention relates generally to card games in which wagers are made, and more particularly to card games in which a dealer plays a card from his hand and the players try to discard a matched card from their hand.

BACKGROUND OF THE INVENTION

The card game "Crazy Eights" is well known and played with great frequency. However, this game is not suited for use as a wagering game since the outcome is generally not determined for a long time after the commencing of the game. Further, the game is not suited for use as a casino type game which for most requires a house advantage and which also generally requires fast-paced action and frequent betting.

The success of blackjack games in casinos and of poker-style sociable as well as house-sponsored games and the like demonstrates the affinity of players for card games that allow the player to make decisions and receive odds for successful wagers. The major drawback to the current popular poker-style casino games is that such games do not allow the player to make decisions about how to play their cards. Rather, the player simply decides how much to bet and whether to increase or decrease the bet, and then the player only can hope that the correct or desired card combinations are dealt to produce a hand with a rank warranting a pay off. The success of blackjack, a game more complicated than the casino poker-type games, is due in large part to the ability of the players to make decisions concerning the play of the hand. However, this popularity is still reduced because the pay off odds for the players are low in comparison to those for the casino poker-style games.

SUMMARY OF THE INVENTION

In accordance with the present invention, there is provided a method of playing a matching wagering game between a player or a group of respective players and a dealer whose outcome is determined by randomly generated playing cards having various ranks and suits. In this method, an ante bet is first wagered by each respective player against the dealer. The dealer then deals a first number of the cards to each respective player to constitute a hand for each respective player, and deals a second number of the cards to himself to constitute a hand of the dealer. The second number of cards is greater than the first number of cards. A round of play of the wagering game is then conducted, which round is commenced by having the dealer play a card from the his hand to present the rank and suit of the played card to each respective player. Next, each respective player plays or discards a card from his respective hand which is considered to match that of the dealer if such a discard is possible. According to the invention, a matching card is one which is one of (a) a card which has the same suit as that of the card played by the dealer, or (b) a card which has the same rank as that of the card played by the dealer. In this manner, each respective player tries to reduce the number of cards in the respective hand thereof by playing a matching card during the round.

The conducting of a round step is then repeated until each card in the hand of the dealer has been played. In this manner, a number of rounds are played each game which is equal to the second number of cards received by the dealer. Thus, at the end of the last round, there are no cards left in the hand of the dealer. At this time, or previously, the ante bet of each respective player is paid off (a) to each respective player if each respective player has no card remaining in the respective hand thereof, or (b) to the dealer where the respective player has one or more cards remaining in the respective hand thereof.

In a preferred embodiment of the method of the present invention, the paying off step to each respective player includes the step of paying off of the ante bet at odds which increase for each earlier round from the last when each respective player played a last card from the respective hand thereof; or the returning of the ante bet of each respective player where each respective player played a last card during the round where the last card of the dealer was played.

In the preferred embodiment, the playing of a card from the respective hand of each respective player step includes the playing of as many cards of the same rank by a player as that of the card played by the dealer during a single round.

In an alternative embodiment, the playing cards include a wild card having no rank or suit but which assumes any suit desired by each respective player. Then, the step of playing of a card from the respective hand of each respective player includes the playing of any one card selected by each respective player from the respective hand thereof where the played card of the dealer is the wild card; and the playing of the wild card from a hand of a player in any round as desired by the player having the wild card in his respective hand.

Preferably, the first number of the cards dealt to each player is five and the second number of the cards dealt to the dealer is seven. Then, prior to the conducting step, each respective player determines whether the respective hand thereof has a hand rank in poker exceeding three of a kind. If the player does have such a highly ranked hand, the player then shows the hand to the dealer who pays off an amount to that player which is a multiple of the ante bet of that player. Most preferably, the pay off to the player with the highly ranked hand is indexed so that each higher rank of hand receives a higher pay off.

It is an advantage of the present invention that a casino wagering game is provided which allows the player to make decisions on how to play the hand dealt to him, without affecting the play of the other players in the game.

It is also an advantage of the present invention that the player receives odds on successful wagers much as in typical casino poker-type games, increasing interest in the game.

It is a further advantage of the present invention that the matching wagering game is easy to learn and fun to play.

Other features and advantages of the present invention are stated in or apparent from detailed descriptions of presently preferred embodiments of the invention found hereinbelow.

BRIEF DESCRIPTION OF THE DRAWING

The single FIGURE is a schematic representation of a gaming table surface for use with the method of the present invention.

DESCRIPTION OF THE PREFERRED EMBODIMENTS

The matching wagering game of the present invention is preferably played with a standard 52 card deck and one joker, so that the deck includes 53 playing cards all together. If desired, a plurality of such decks are used together in a suitable shoe or the like so that a new shuffle is not required after each game. The joker is considered a "wild" card, as discussed subsequently. Broadly, the object of the game is for the player to have a ranked poker hand when the cards are dealt, and/or for the player to discard cards from his hand which match those of the dealer before the dealer discards all of the cards in the dealer's hand (which initially exceeds the number in the player's hand).

In a casino setting, or equally as well in a social setting, the wagering game is preferably played on a table surface 10 having a straight dealer side 12 behind which the dealer is located and a curved player side 14 behind which at least one and preferably a plurality of respective players are located. On surface 10 adjacent dealer side 12 is a display 16 including seven different boxes 18. When the wagering game is played, the dealer will deal a respective card on top of each respective box 18. Behind display 16 is a token holder or bank 20 in which tokens of various denominations may be kept to enable the dealer to pay off winning wagers or to collect losing wagers of the players.

Also provided on surface 10 is a plurality of displays 22, one for each player participating in the wagering game. Each display 22 includes a wagering area 24 on which the wager of each respective player is placed and a discard area 26 on which a player may display a card which is discarded according to the method of play of the wagering game as explained subsequently. Preferably, the wager is simply an ante bet of some minimum and maximum amount which is made using suitable tokens at the beginning of each game played. During play, the players can hold their cards in their hands, or leave them on surface 10 adjacent the respective discard area 26 of the respective player.

The method of playing of the matching wagering game of the present invention is as follows. Initially, each player participating in the game is required to place an ante bet in the wagering area 24 in front of that player. Next, after a suitable shuffling of the deck of cards by the dealer (if needed), the dealer deals a first predetermined number of cards face down onto surface 10 to each player to constitute a hand for that player, and the dealer deals himself a second predetermined number of cards face down with one card on top of each of the boxes 18 to constitute a hand for the dealer. It will be appreciated that the first predetermined number of cards dealt to each player is preferably five, while the second predetermined number, which is larger than the first predetermined number, is preferably seven in this preferred embodiment. Conveniently, the dealer deals the cards in a rotation to each player and to himself until each player as well as the dealer has five cards, and then the dealer deals himself two further cards. Of course, if desired, the dealer could also simply deal five cards consecutively to each player and then seven cards to himself. It will also be appreciated that the hands of the players could be dealt face up, as each player is only playing against the dealer and there is no advantage to the dealer in knowing the players' cards as the play of the dealer is predetermined and without variance.

After the players receive the five cards for their hands, each player reviews his hand to determine whether the hand has a rank in the game of poker exceeding some predetermined rank, which in this preferred embodiment is a rank of exceeding three of a kind. If the player (or more than one player) does have a hand with such a rank, this fact is immediately announced and the winning hand displayed to the dealer who verifies this. After verification, the dealer immediately pays an amount determined by the value of the ante bet made by the player with the winning hand. Preferably, the pay off is also indexed to the rank of the hand according to a predetermined pay chart, which may include the following preferred pay offs:

| HAND RANK | PAYOFF |
|---|---|
| Straight | 2 to 1 |
| Flush | 5 to 1 |
| Full House | 10 to 1 |
| Four of a Kind | 25 to 1 |
| Straight Flush | 100 to 1 |
| Five of a Kind | 250 to 1 |
| Royal Flush | 1000 to 1 |

In determining hand rank, the joker is preferably used as a wild card in all hands, except a Royal Flush (which by the rules can only be obtained naturally).

After the cards are all dealt and any payoffs are made for poker hands having a rank exceeding three of a kind, a round of the matching wagering game is conducted. A round of play commences with the dealer playing or placing a first one of the cards of his hand face up in the associated box 18, preferably beginning with the card on top of the left-most (as viewed by the dealer) box 18. After the card of the dealer is turned face up revealing the rank and suit of thereof, each player in turn is invited by the dealer to discard or play a "matching" card from the respective player's hand onto the respective discard area 26 of the player where the dealer verifies that it is a matching card. A matching card is one of: (a) a card which has the same suit as that of the card played by the dealer, or (b) a card which has the same rank as that of the card played by the dealer.

Preferably, when the player has more than one card of the same rank as that of the card played by the dealer, that player can (and should) discard all of such ranked cards. However, the player can only discard one card of the same suit, no matter how many cards of the same suit the player has.

If the card played by the dealer is a joker or wild card, each player may play any one card in his hand (as by definition the card can be considered to be a match by the player). However, the player cannot designate the joker as a ranked card in order to play two or more similarly ranked cards. Thus, when the dealer plays a joker, in effect each player can only designate that card to have a suit desired by that player; but not a rank, so that multiple cards cannot be discarded when the dealer plays a joker.

Where the player has a joker or wild card, the player can similarly designate that joker to have any desired suit, but not rank. Thus, the player can only discard the joker by itself, and not as one of a number of similarly ranked cards (matching the rank of the card played by the dealer).

Each time that a player discards one (or more) cards, the number of cards remaining in the hand of the player is reduced. As noted above, the object of the wagering game is to discard all of the cards from the hand of the player before all of the cards of the dealer are played. Therefore, after the first round of play, the dealer must take note of whether any player has discarded all of the cards from his hand. If no player has discarded the last card from his hand, then another round of play is conducted by the dealer by the displaying of a next card from the hand of the dealer. Ultimately, seven rounds of play will be conducted as the dealer displays the seven cards of his hand in order (unless all players have discarded their last card already).

Whenever a player discards the last card (or last cards, if more than one is discarded) from his hand before the dealer has played his last card, the dealer acknowledges that that player is out of cards and pays off the player as a winner of the ante bet. Preferably, this occurs as soon as the last card is played by the player, that is in the middle of the round. Also preferably, the pay off of the ante bet for the player who has played all of his cards is indexed to the round or number of cards already played by the dealer, such as using the following pay offs:

| CARDS PLAYED BY DEALER | PAYOFF |
|---|---|
| 1 | 6 to 1 |
| 2 | 5 to 1 |
| 3 | 4 to 1 |
| 4 | 3 to 1 |
| 5 | 2 to 1 |
| 6 | 1 to 1 |
| 7 | Push |

Where the player does not discard the last card (s) from his hand until after the dealer has played his last (seventh) card, the ante bet is simply returned to the player (or carried forward to the next game if desired as a "push"). However, where the player has one or more cards remaining in his hand after the last round where the dealer played his last (seventh) card, the player loses his ante bet. Thus, as the dealer invites each player in turn to discard during the last round, the dealer will take the ante bet of any player who has one or more cards remaining in his hand after the player makes his last play.

It will be appreciated that it is possible for a player to discard all five of his cards when the dealer has played only one card, and thus to collect on the 6 to 1 odds, only if the player has five of a kind without a joker. Five of a kind without a joker is only possible where a plurality of decks of cards are mixed together as mentioned above.

However, in the preferred embodiment where it is desired not to use a plurality of decks, in order to afford a player an opportunity to discard all of his cards after the dealer plays only one card, an exception to the above mentioned method of play is provided. The exception is that when the first card is played by the dealer (and only on that first card), a player may play five cards of a matching suit. In this manner, if the player has a flush and the first card played by the dealer is the same suit as the flush, the player can discard all five cards of the flush. Obviously, other such exceptions can also be substituted or made in addition to that mentioned above.

In accordance with the method of play of the invention described above, it will be appreciated by those of ordinary skill in the art that the house hold will be about 0.032.

While the present invention has been described with respect to exemplary embodiments thereof, it will be understood by those of ordinary skill in the art that variations and modifications can be effected within the scope and spirit of the invention.

We claim:

1. A method of playing a matching wagering game between a respective player or a group of respective players and a dealer whose outcome is determined by randomly generated playing cards having various ranks and suits, said method comprising the steps of:

wagering an ante bet by each respective player against the dealer;

dealing of a first number of the cards by the dealer to each respective player to constitute a hand for each respective player, and dealing of a second number of the cards by the dealer to the dealer to constitute a hand of the dealer where the second number of cards is greater than the first number of cards;

conducting of a round of play including the steps of (a) playing of a card from the hand of the dealer to present the rank and suit of the played card to each respective player;

(b) playing of a card from the respective hand by each respective player which is one of (i) a card which has the same suit as that of the card played by the dealer, or (ii) a card which has the same rank as that of the card played by the dealer, whereby each respective player reduces the number of cards in the respective hand thereof where a card is played during the round;

repeating of the conducting step until each card in the hand of the dealer has been played so that there are no cards left in the hand of the dealer;

paying off of the ante bet of each respective player to (a) each respective player if each respective player has no card remaining in the respective hand thereof, or (b) the dealer if each respective player has one or more cards remaining in the respective hand thereof.

2. A method of playing a matching wagering game as claimed in claim 1 wherein said paying off step to each respective player includes the step of paying off of the ante bet at odds which increase for each earlier round from the last when each respective player played a last card from the respective hand thereof.

3. A method of playing a matching wagering game as claimed in claim 2 wherein said paying off step to each respective player includes the step of returning the ante bet of each respective player where each respective player played a last card during the round where the last card of the dealer was played.

4. A method of playing a matching wagering game as claimed in claim 3 wherein said playing of a card from the respective hand of each respective player step includes the playing of as many cards of the same rank as that of the card played by the dealer during a single round.

5. A method of playing a matching wagering game as claimed in claim 4 wherein in said dealing step the first number of the cards is five and the second number of the cards is seven.

6. A method of playing a matching wagering game as claimed in claim 5 and further including, prior to said conducting step, the steps of determining by each respective player whether the respective hand thereof has a hand poker rank exceeding three of a kind, showing of the hand of the player which has a hand rank exceeding three of a kind, and paying off of an amount by the dealer to the player having a hand rank exceeding three of a kind of a multiple of the ante bet of that player.

7. A method of playing a matching wagering game as claimed in claim 6 wherein said paying off to the player having a hand rank exceeding three of a kind step includes the step of indexing the pay off so that each higher rank of hand receives a higher pay off.

8. A method of playing a matching wagering game as claimed in claim 7 wherein the playing cards include a wild card having no rank or suit but which assumes any suit desired by each respective player; and wherein said step of playing of a card from the respective hand of each respective player of said conducting step includes the playing any one card selected by each respective player from the respective hand thereof where the played card of the dealer is the wild card and the playing of the wild card from a hand of a player in any round selected by the player with the wild card in the respective hand.

9. A method of playing a matching wagering game as claimed in claim 1 wherein said playing of a card from the respective hand of each respective player step includes the playing by any player of as many cards of the same rank as that of the card played by the dealer during a single round.

10. A method of playing a matching wagering game as claimed in claim 1 wherein the playing cards include a wild card having no rank or suit but which assumes any suit desired by each respective player; and wherein said step of playing of a card from the respective hand of each respective player of said conducting step includes the playing any one card selected by each respective player from the respective hand thereof where the played card of the dealer is the wild card and the playing of the wild card from a hand of a player in any round selected by the player with the wild card in the respective hand.

11. A method of playing a matching wagering game as claimed in claim 1 wherein in said dealing step the first number of the cards is five and the second number of the cards is seven.

12. A method of playing a matching wagering game as claimed in claim 11 and further including, prior to said conducting step, the steps of determining by each respective player whether the respective hand thereof has a hand poker rank exceeding three of a kind, showing of the hand of the player which has a hand rank exceeding three of a kind, and paying off of an amount by the dealer to the player having a hand rank exceeding three of a kind of a multiple of the ante bet of that player.

13. A method of playing a matching wagering game as claimed in claim 12 wherein said paying off to the player having a hand rank exceeding three of a kind step includes the step of indexing the pay off so that each higher rank of hand receives a higher pay off.

* * * * *